US011220849B2

(12) United States Patent
Kozaki et al.

(10) Patent No.: US 11,220,849 B2
(45) Date of Patent: Jan. 11, 2022

(54) HOOD LOCK APPARATUS

(71) Applicant: MITSUI KINZOKU ACT CORPORATION, Yokohama (JP)

(72) Inventors: Mizuki Kozaki, Yokohama (JP); Toshihisa Nishijo, Yokohama (JP); Shunsuke Tamura, Yokohama (JP)

(73) Assignee: MITSUI KINZOKU ACT CORPORATION, Yokohama (JP)

( * ) Notice: Subject to any disclaimer, the term of this patent is extended or adjusted under 35 U.S.C. 154(b) by 698 days.

(21) Appl. No.: 15/949,963

(22) Filed: Apr. 10, 2018

(65) Prior Publication Data

US 2018/0298652 A1 Oct. 18, 2018

(30) Foreign Application Priority Data

Apr. 14, 2017 (JP) ..... JP2017-080673

(51) Int. Cl.
*E05B 83/24* (2014.01)

(52) U.S. Cl.
CPC ..... *E05B 83/243* (2013.01); *E05B 83/24* (2013.01)

(58) Field of Classification Search
CPC ..... E05B 83/24; E05B 83/16; E05B 77/08; E05B 83/243; Y10S 292/14; Y10S 292/42; B60R 21/34; B60R 21/0136; B62D 25/10; E05Y 2900/536
See application file for complete search history.

(56) References Cited

U.S. PATENT DOCUMENTS 5,141,265 A 8/1992 Claar et al.
6,543,822 B1 4/2003 King et al.
2009/0250945 A1* 10/2009 Hwang ..... E05B 77/08 292/99
2012/0043766 A1* 2/2012 Nurmi ..... E05B 83/24 292/126

(Continued)

FOREIGN PATENT DOCUMENTS

CN 102966278 A 3/2013
CN 103158785 A 6/2013

(Continued)

OTHER PUBLICATIONS

Japanese Office Action dated Nov. 26, 2019 for corresponding Application No. 2017-080673.

(Continued)

*Primary Examiner* — Mark A Williams
(74) *Attorney, Agent, or Firm* — Foley & Lardner LLP

(57) ABSTRACT

A hood lock apparatus includes: a primary lock portion holding a hood in a fully closed state; and a secondary lock portion holding the hood in a half open state and including a catcher attached to a vehicle body, a base attached to the hood, and a latch supported on the base, rotatable between a latching position and an unlatching position and including a hook portion locking the catcher when the hood is opened to the half open state with the latch being at the latching position, an operating portion operating the latch to rotate toward the unlatching position, and an abutment portion abutting the catcher when the hood is fully closed state with the latch being at the unlatching position. The latch is rotated to the latching position by the abutment of the abutment portion with the catcher.

6 Claims, 6 Drawing Sheets

(56) References Cited

U.S. PATENT DOCUMENTS

| | | | | |
|---|---|---|---|---|
| 2012/0049543 | A1* | 3/2012 | Park | E05B 83/24 292/220 |
| 2012/0217761 | A1* | 8/2012 | Nakamura | B60R 21/34 292/97 |
| 2012/0261929 | A1* | 10/2012 | Bruck | B60N 2/366 292/226 |
| 2012/0280519 | A1* | 11/2012 | Hong | E05B 83/24 292/128 |
| 2013/0049403 | A1 | 2/2013 | Fannon et al. | |
| 2013/0221685 | A1* | 8/2013 | Polewarczyk | E05B 83/243 292/52 |
| 2014/0015258 | A1* | 1/2014 | Barczynski | E05B 83/24 292/100 |
| 2014/0054903 | A1 | 2/2014 | Kim et al. | |
| 2014/0175837 | A1* | 6/2014 | Min | B60R 21/34 296/193.11 |
| 2014/0210220 | A1* | 7/2014 | Limberg | E05B 83/24 292/216 |

FOREIGN PATENT DOCUMENTS

| | | | |
|---|---|---|---|
| CN | 103628755 | A | 3/2014 |
| EP | 2615012 | A1 | 7/2013 |
| GB | 0 387 532 | A | 2/1933 |
| JP | S55-035382 | Y2 | 8/1980 |
| JP | H04-002291 | Y2 | 1/1992 |
| JP | H06-221041 | A | 8/1994 |
| JP | 2784697 | B2 | 8/1998 |
| JP | 5136702 | B2 | 2/2013 |
| JP | 2014-145184 | A | 8/2014 |

OTHER PUBLICATIONS

China Office Action for App. No. 201810311068X dated Jul. 24, 2019—11 pages.

* cited by examiner

HOOD LOCK APPARATUS

This application claims priority from Japanese Patent Application No. 2017-080673 filed on Apr. 14, 2017, the entire subject-matter of which is incorporated herein by reference.

TECHNICAL FIELD

The disclosure relates to a hood lock apparatus for holding a hood which can be opened and closed on a vehicle body in a closed state.

BACKGROUND

There has been known a hood lock apparatus including a primary lock portion for holding a hood of a vehicle in a fully closed state and a secondary lock portion for holding the hood which is being opened in a half open state. The secondary lock portion is designed to prevent the hood from being opened fully in the event that the primary lock portion is erroneously operated to release the locking of the hood thereby while the vehicle is driving.

The secondary lock portion typically includes a catch which is attached to a vehicle body, a latch which is attached to the hood and a lever which operates the latch. The latch can rotate between a latching position and an unlatching position. When the hood is opened to the half open state, the catch is locked by the latch which is positioned in the latching position, whereby the hood is held in the half open state. Then, the latch is rotated to the unlatching position by the lever being operated from a gap defined between a front end of the hood and the vehicle body with the hood held in the half open state. The latch then releases the locking of the catch thereby in response to a rotation of the latch to the unlatching position, whereby the hood can be opened fully (for example, refer to U.S. Pat. No. 6,543,822 and Japanese Patent No. 5136702).

The hood lock apparatus is exposed to the environment outside the vehicle, and therefore, there are fears that rust and/or blisters (swelling of a paint coat) are generated on or sandy dust adheres to the hood lock apparatus. Then, the rotation of the latch of the secondary lock portion is disturbed by rust, blisters, sandy dust or the like, resulting in fears that the latch is caused to stick to the unlatching position. In the event that the latch sticks to the unlatching position, the latch does not function to lock the catch, which can cause a problem in driving the vehicle. Because of this, in the secondary lock portion of the hood lock apparatus described in U.S. Pat. No. 6,543,822, when the hood is closed from the half open state to the fully closed state, the lever is pushed by the catcher to rotate, and when the latch stays in the unlatching position, the latch is forced to be disposed in the latching position as the lever rotates.

Incidentally, rigidity which is good enough to ensure the operability of the lever which operates the latch is set on the lever. Then, in the secondary lock portion of the hood lock apparatus described in U.S. Pat. No. 6,543,822, the lever which operates the latch extends in a front-and-rear direction of the vehicle body. When the hood stays in the fully closed state or the half open state, the rigidity of the lever constitutes a resistance against a deformation which is generated in the hood when the vehicle is involved in a frontal collision, resulting in fears that the shock absorbing performance of the hood is deteriorated.

In the secondary lock portion of the hood lock apparatus described in Japanese Patent No. 5136702, too, the lever extends in a front-and-rear direction of a vehicle. However, when the lever operates to displace its distal end to the rear of the vehicle, the linkage of the lever with the latch is cut out, and the lever can operate independently of the latch. When the vehicle is involved in a frontal collision, the lever is permitted to operate to displace its distal end to the rear of the vehicle, whereby the impact absorbing performance of the hood is maintained. On the other hand, the configuration realizing this becomes complex.

SUMMARY

Illustrative aspects of the disclosure provide a hood lock apparatus which is superior in reliability and which can enhance a safety performance thereof with a simple configuration.

According to one illustrative aspect of the disclosure, there may be provided a hood lock apparatus comprising: a primary lock portion configured to hold a hood in a fully closed state, the hood being opened and closed on a vehicle body; and a secondary lock portion configured to hold the hood, which is being opened, in a half open state, the secondary lock portion comprising: a catcher attached to the vehicle body; a base attached to the hood; and a latch supported on the base and configured to rotate between a latching position and an unlatching position, the latch being rotatable about a shaft extending in a longitudinal direction of the vehicle body as a rotational center, wherein the latch comprises: a hook portion configured to lock the catcher when the hood is opened to the half open state with the latch being at the latching position; an operating portion configured to operate the latch to rotate toward the unlatching position; and an abutment portion configured to be brought into abutment with the catcher when the hood is closed from the half open state to the fully closed state with the latch being at the unlatching position, and wherein the latch is rotated to the latching position by the abutment of the abutment portion with the catcher.

According to the disclosure, it is possible to provide the hood lock apparatus which can not only provide the superior reliability but also enhance the safety performance with the simple configuration.

DETAILED DESCRIPTION

Figure 1:
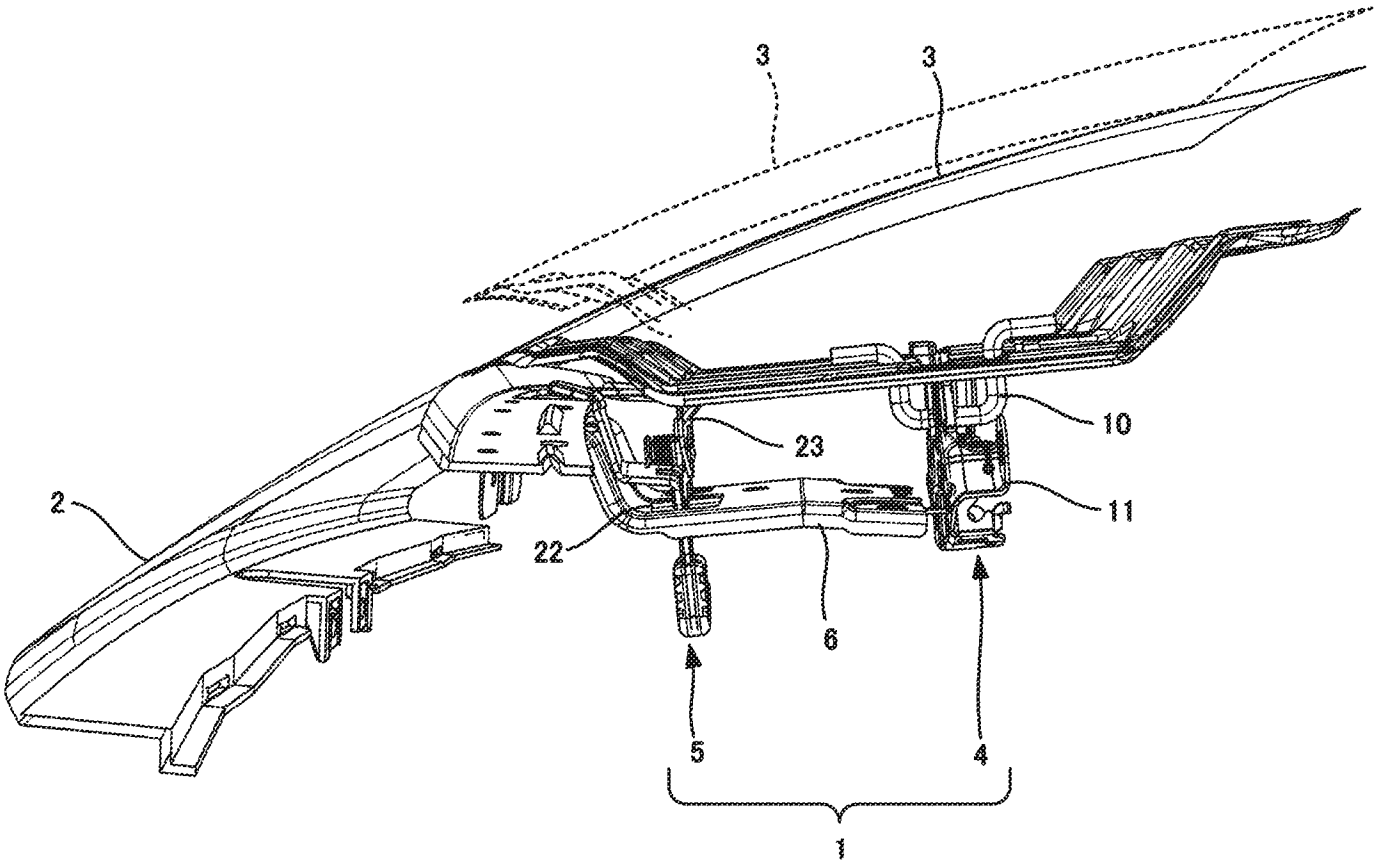
FIG. 1 is a side view of an example of a hood lock apparatus which describes an illustrative embodiment of the disclosure.

FIG. 1 shows an example of a hood lock apparatus which describes an illustrative embodiment of the disclosure.

A hood lock apparatus 1 is installed in a vehicle. The vehicle includes a hood 3 that covers an engine compartment of a vehicle body 2. An end portion of the hood 3 at a rear side of the vehicle body 2 (which will also be referred to as a second end portion of the hood 3 or a rear end portion of the hood 3) is supported rotatably on the vehicle body 2 so that an end portion of the hood 3 at a front side of the vehicle body 2 (which will also be referred to as a first end portion of the hood 3 or a front end portion of the hood 3) is lifted up and down to be opened and closed on the vehicle body 2. The hood lock apparatus 1 includes a primary lock portion 4 and a secondary lock portion 5. The primary lock portion 4 is configured to hold the hood 3 in a fully closed state (refer to solid line in FIG. 1). The secondary lock portion 5 is configured to hold the hood 3 that is being opened in a half open state (refer to broken line in FIG. 1).

Figure 2:
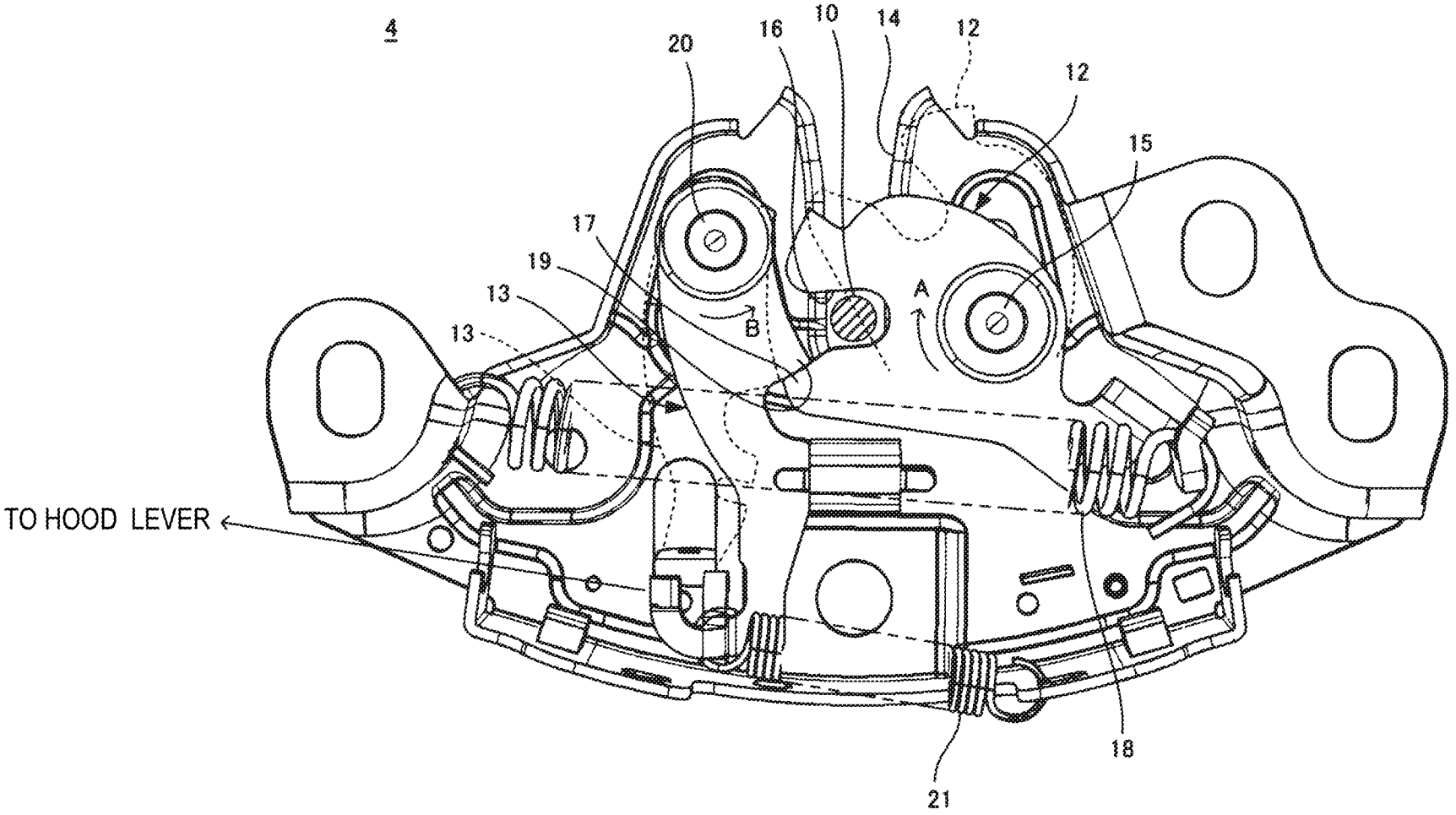
FIG. 2 is a front view of a primary lock portion of the hood lock apparatus shown in FIG. 1.

FIG. 2 shows the primary lock portion 4.

The primary lock portion 4 is disposed substantially at a center in a widthwise direction of the vehicle body 2. The primary lock portion 4 includes a striker 10, a primary base 11, and a primary latch 12 and a locking plate 13. The striker 10 is attached to the hood 3. The primary base 11 is attached to the vehicle body 2 via a bracket 6. The primary latch 12 and the locking plate 13 are supported rotatably on the primary base 11. The striker 10, the primary base 11, the primary latch 12 and the locking plate 13 are made of steel, for example.

The primary base 11 has a striker groove 14 which is opened towards an upper side of the vehicle body 2. The striker 10 enters the striker groove 14 as the hood 3 is operated to be closed.

The primary latch 12 has a locking groove 16 for locking the striker 10. An engaging portion 17 is configured to be brought into engagement with the locking plate 13. The engaging portion 17 is provided an open end portion of the locking groove 16. The primary latch 12 is disposed on one side, that is, either a left-hand side or a right-hand sides of the striker groove 14 of the primary base 11. The primary latch 12 is supported rotatably by a primary latch shaft 15 provided on the primary base 11 so as to be rotated between a latching position, which is indicated by a solid line in FIG. 2, and an unlatching position, which is indicated by a broken line in FIG. 2.

When the primary latch 12 stays in the unlatching position, an opening of the locking groove 16 of the primary latch 12 is disposed so as to overlap an opening of the striker groove 14 of the primary base 11. On the other hand, when the primary latch 12 stays in the latching position, the opening of the locking groove 16 is disposed out of the striker groove 14.

The primary latch 12 is biased in a direction indicated by an arrow A toward the unlatching position by a coiled primary latch spring 18. One end of the primary latch spring 18 is fixed to the primary base 11, and the other end of the primary latch spring 18 is fixed to the primary latch 12.

The locking plate 13 has an engaging portion 19 configured to be brought into engagement with the engaging portion 17 of the primary latch 12. The locking plate 13 is disposed opposite to the primary latch 12 across the striker groove 14 in the primary base 11. The locking plate 13 is supported rotatably by a locking plate shaft 20 provided on the primary base 11 so as to be rotated between a locking position, which is indicated by a solid line in FIG. 2, and an unlocking position, which is indicated by a broken line in FIG. 2.

The engaging portion 17 of the primary latch 12 and the engaging portion 19 of the locking plate 13 are in engagement with each other when the primary latch 12 stays in the latching position and the locking pate 13 stays in the locking position. On the other hand, the engagement between the engaging portion 17 and the engaging portion 19 is released when the locking plate 13 stays in the unlocking position.

Then, the locking plate 13 is biased in a direction indicated by an arrow B toward the locking position by a coiled locking plate spring 21. On end of the locking plate spring 21 is attached to the primary base 11, and the other end of the locking plate spring 21 is attached to the locking plate 13.

The locking plate 13 is connected to a hood lever that is provided inside a passenger compartment by way of a wire, not shown. The locking plate 13 is rotated in an opposite direction to the direction indicated by the arrow B toward the unlocking position when the hood lever is operated.

Hereinafter, an operation of the primary lock portion 4 will be described.

Firstly, it should be understood that the hood 3 is opened and that the primary latch 12 is disposed in the unlatching position.

The striker 10 is lowered as the hood 3 is operated to be closed and enters the striker groove 14 in the primary base 11 and enters further the locking groove 16 in the primary latch 12 staying in the unlatching position. Then, the striker 10 having entered the locking groove 16 moves on toward a bottom of the striker groove 14 while rotating the primary latch 12 toward the latching position by pressing against a side wall of the locking groove 16 positioned forward in a traveling direction of the striker 10.

When the striker 10 arrives at a bottom portion of the striker groove 14, the primary latch 12 is disposed in the latching position, and the locking plate 13 is disposed in the locking position by being biased by the locking plate spring 21. This brings the engaging portion 17 of the primary latch 12 into engagement with the engaging portion 19 of the locking plate 13, whereby the primary latch 12 is prevented from being rotated toward the unlatching position. The striker 10 is locked by the primary latch 12 so as not to be allowed to exit from the striker groove 14. Thus, the hood 3 is held in a fully closed state indicated by a solid line shown in FIG. 1.

When the hood 3 is opened, the hood lever is operated, and the locking plate 13 is disposed in the unlocking position, whereby the engagement between the engaging portion 17 of the primary latch 12 and the engaging portion 19 of the locking plate 13 is released. This enables the primary latch 12 to rotate toward the unlatching position and is then biased by the primary latch spring 18 to be disposed in the unlatching position. As the primary latch 12 rotates toward the unlatching position, the striker 10 is pushed up by the primary latch 12, whereby the hood 3 is popped up to a half open state which is indicated by a broken line in FIG. 1.

Figure 3:
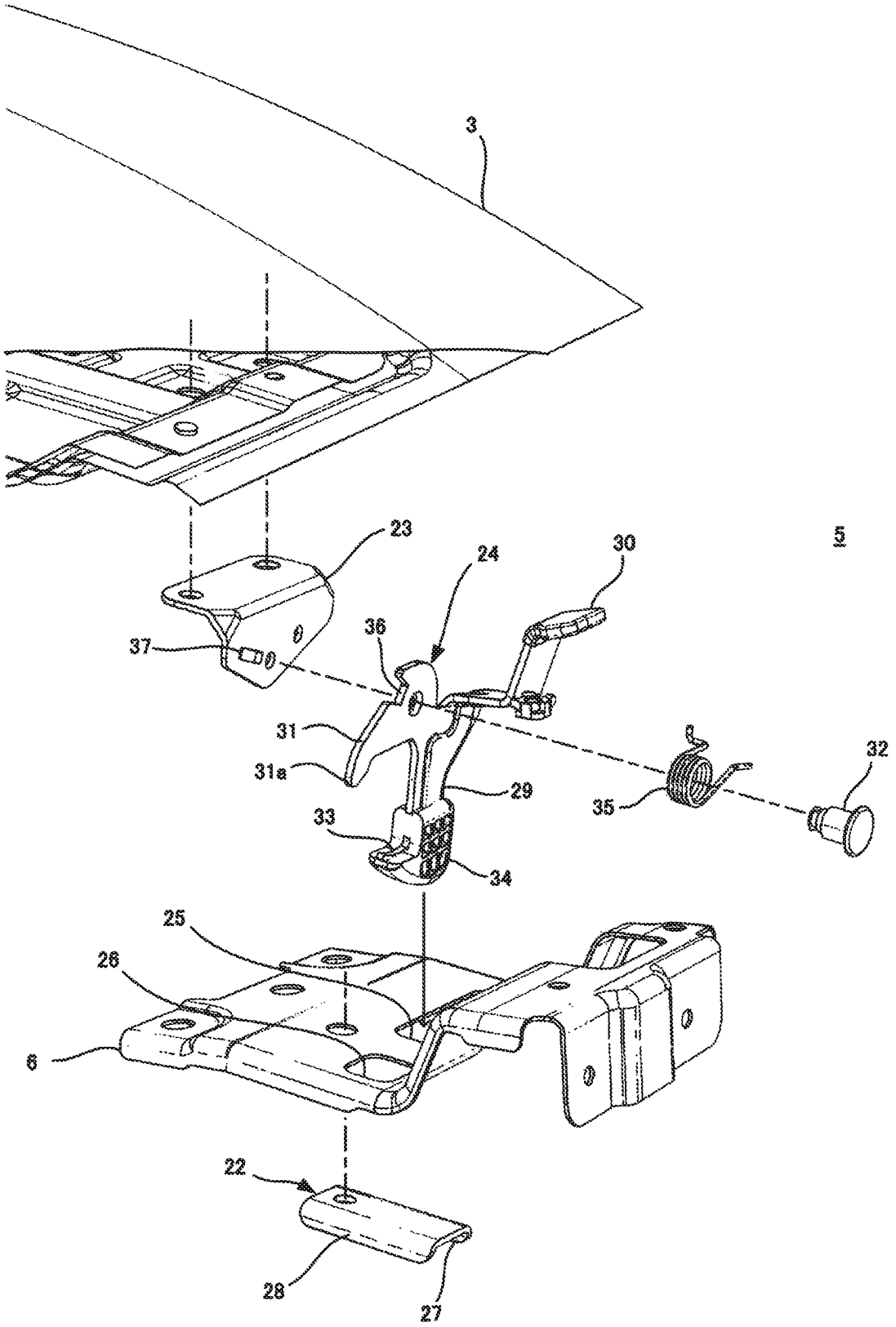
FIG. 3 is an exploded perspective view of a secondary lock portion of the hood lock apparatus shown in FIG. 1.
Figure 4:
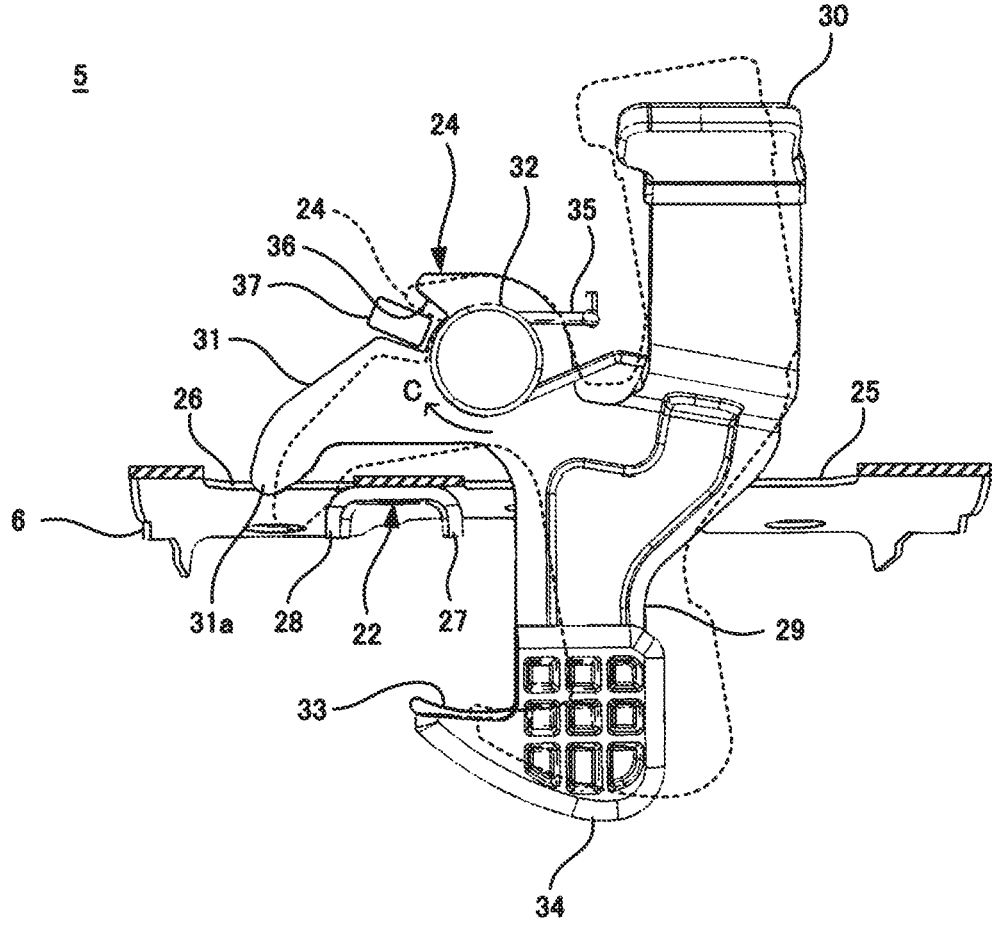
FIG. 4 is a front view of the secondary lock portion shown in FIG. 3.

FIGS. 3 and 4 show the secondary lock portion 5.

The secondary lock portion 5 is disposed substantially at a center in the widthwise direction of the vehicle body 2. In other words, the secondary lock portion 5 is provided to be aligned with the primary lock portion 4 in a front-and-rear direction (longitudinal direction) of the vehicle body 2 and is disposed further forwards toward a front side of the vehicle body 2.

The secondary lock portion 5 includes a catcher 22, a secondary base 23 and a secondary latch 24. The catcher 22 is attached to the vehicle body 2 via the bracket 6. The secondary base 23 is attached to the hood 3. The secondary latch 24 is supported rotatably on the secondary base 23. The secondary lock portion 5 stops the hood 3, which is popped up by the action of the primary lock portion 4 at a predetermined angle as a result of the catcher 22 being locked by the secondary latch 24, and then holds the hood 3 in a half open state. The catcher 22, the secondary base 23 and the secondary latch 24 are made of steel, for example.

The catcher 22 is fixed to a lower surface of the bracket 6 facing a lower side of the vehicle body 2. A first opening portion 25 and a second opening portion 26 are provided in the bracket 6. The first opening portion 25 is provided so as to be adjacent to one end of the catcher 22 in the widthwise direction. The second opening portion 26 is provided so as to be adjacent to the other end of the catcher 22 in the widthwise direction.

A locked portion 27 configured to be locked by the secondary latch 24 is provided at one end portion of the catcher 22 in the widthwise direction facing the first opening portion 25. An abutment portion 28 is provided at the other end portion of the catcher 22 in the widthwise direction facing the second opening portion 26. The abutment portion 28 is disposed so as to project into the second opening portion 26.

The secondary latch 24 has a hook portion 29, an operating portion 30 and an abutment portion 31. The hook portion 29 is configured to lock the locked portion 27 of the catcher 22. The secondary latch 24 is supported rotatably by a secondary latch shaft 32 that is provided on the secondary base 23 so as to extend in the longitudinal direction of the vehicle body 2. An arc-shaped cut-out portion 36 that is centered at the secondary latch shaft 32 is provided in the secondary latch 24. A stopper 37 configured to be accommodated in the cut-out portion 36 is provided on the secondary base 23. The secondary latch 24 is rotatable between a latching position (which is indicated by a solid line in FIG. 4) where the stopper 37 is brought into abutment with one end of the cut-out portion 36 and an unlatching position (which is indicated by a broken line in FIG. 4) where the stopper 37 is brought into abutment with the other end of the cut-out portion 36.

The hook portion 29 extends from the secondary latch shaft 32 toward the lower side of the vehicle body. The hook portion 29, which is configured to be lowered as the hood 3 is operated to be closed, is passed through the first opening portion 25 in the bracket 6. When the hood 3 is within an opening angle range from a fully closed state to a half open state, a lower end portion of the hook portion 29 is disposed on a lower surface side of the bracket 6. A locking portion 33 is provided at a lower end portion of the hook portion 29 so as to be brought into engagement with the locked portion 27 of the catcher 22. The lower end portion of the hook portion 29 excluding the locking portion 33 is covered by a synthetic resin cover 34 from the view point of protecting an occupant who opens the hood 3.

When the secondary latch 24 is in the latch position with the lower end portion of the hook portion 29 disposed on the lower surface side of the bracket 6, the locking portion 33 of the hook portion 29 is disposed in a position below the locked portion 27 of the catcher 22 and is brought into engagement with the locked portion 27 as the hood 3 is operated to be opened. On the other hand, when the secondary latch 24 is in the unlatching position, the locking portion 33 is disposed out of the position below the locked portion 27.

Then, the secondary latch 24 is biased in a direction indicated by an arrow C toward the latching position by a coiled secondary latch spring 35 (one example of an elastic member) that is wound around the secondary latch shaft 32 (see FIG. 4, for example). Incidentally, the secondary latch spring 35 is provided between the secondary latch 24 and the secondary latch shaft 32 in the front-and-rear direction of the vehicle body (longitudinal direction of the secondary latch shaft 32).

The operating portion 30 extends from the secondary latch shaft 32 toward the upper side and the front side of the vehicle body 2. A distal end portion of the operating portion 30 is disposed near the front end portion of the hood 3 at the front side of the vehicle body 2. A gap is formed between the vehicle body 2 and the front end portion of the hood 3 at the front side of the vehicle body 2 (refer to FIG. 1), and the operating portion 30 is operated through the gap. Then, when the operating portion 30 is operated in the way described above, the secondary latch 24 is rotated in an opposite direction to the direction indicated by the arrow C toward the unlatching position.

The abutment portion 31 extends from the secondary latch shaft 32 in the widthwise direction of the vehicle body 2. A distal end portion 31*a* of the abutment portion 31 is disposed above the second opening portion 26 in the bracket 6. When the secondary latch 24 is in the latching position, the distal end portion 31*a* of the abutment portion 31, which is configured to be lowered as the hood 3 is operated to be closed, straddles the catcher 22 to be accommodated in the second opening portion 26. On the other hand, when the secondary latch 24 is in the unlatching position, the distal end portion 31*a* of the abutment portion 31 is displaced toward the catcher 22, and the distal end portion 31*a* of the abutment portion 31, which is configured to be lowered as the hood 3 is operated to be closed, is brought into abutment with the abutment portion 28 of the catcher 22 that is disposed to project through the second opening portion 26.

Hereinafter, an operation of the secondary lock portion 5 will be described.

It is assumed that the hood 3 is held in the fully closed state by the primary lock portion 4 and that the secondary latch 24 is disposed in the latching position.

When the hood 3 is popped up by the action of the primary lock portion 4, the locking portion 33 of the hook portion 29 of the secondary latch 24 is brought into engagement with the locked portion 27 of the catcher 22 as the hood 3 is popped up (is operated to be opened), whereby the secondary latch 24 is prevented from moving upwards. This stops the hood 3 which is being popped up at a predetermined opening angle, whereby the hood 3 is held in a half open state.

When the secondary latch 24 is disposed in the unlatching position as a result of the operating portion 30 of the secondary latch 24 being operated through a gap (refer to FIG. 1) which is now opened between the front end portion of the hood 3 which is held in the half open state and the vehicle body 2, the engagement between the locked portion 27 of the catcher 22 and the locking portion 33 of the hook portion 29 is released, whereby the hood 3 can be opened fully.

The secondary latch 24, which is disposed in the unlatching position by operating the operating portion 30, is normally biased by the secondary latch spring 35 to be disposed in the latching position again when the operating portion 30 is released. Even though the secondary latch 24 is caused to stick to the unlatching position due to rust, blisters, sandy dust or the like, the secondary latch 24 is forced to be disposed in the latching position as the hood 3 is operated to be closed.

Figure 5:
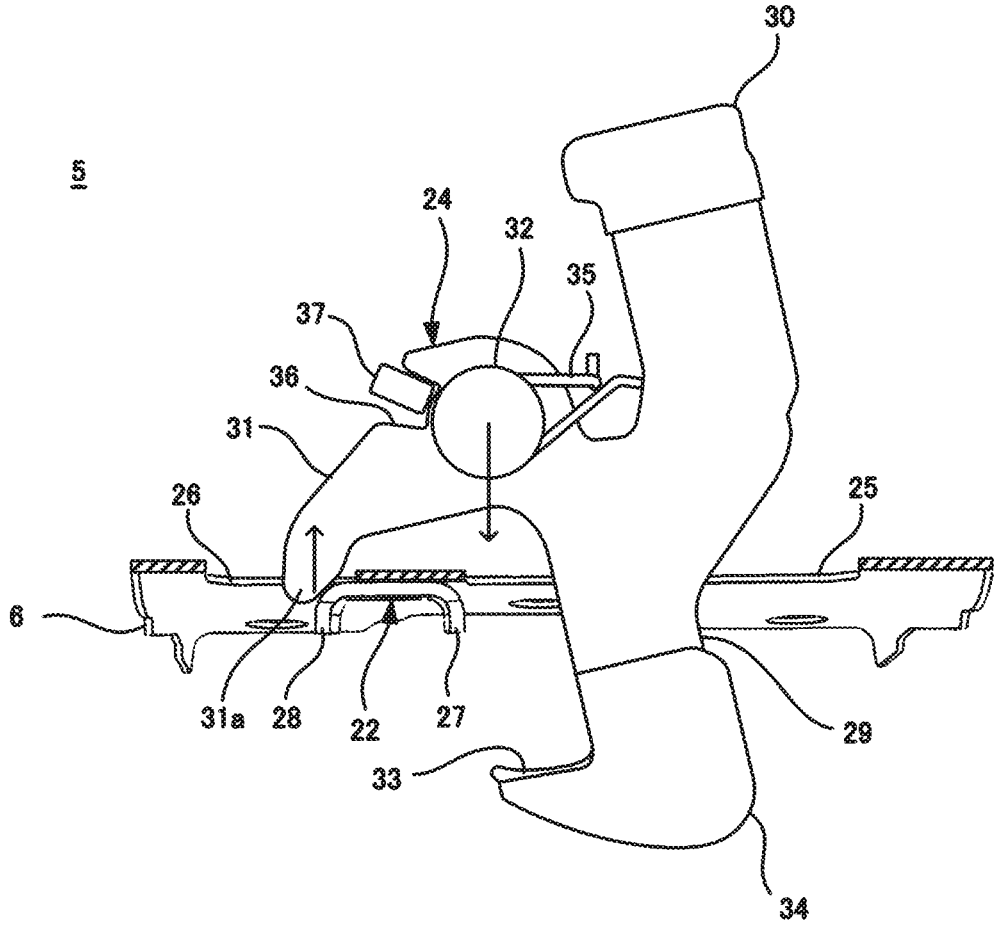
FIG. 5 is a view showing an operation of the secondary lock portion shown in FIG. 4.
Figure 6:
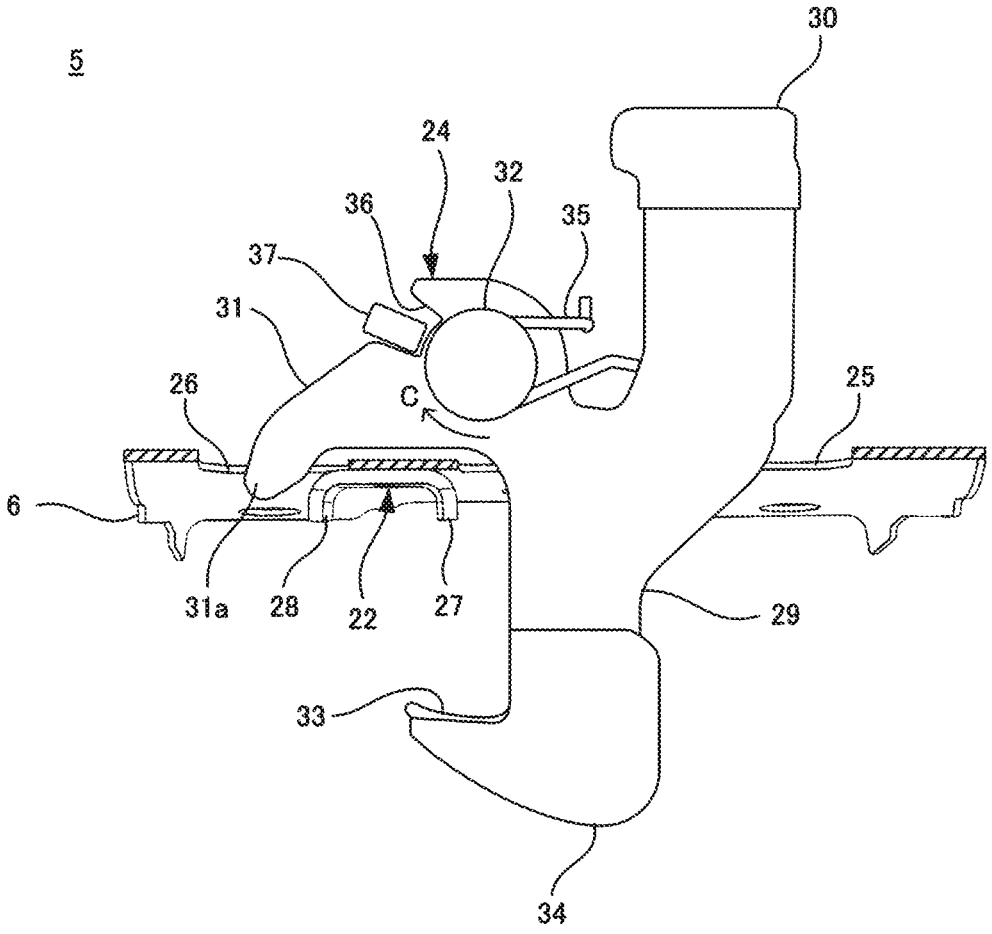
FIG. 6 is a view showing an operation of the secondary lock portion shown in FIG. 4.

FIGS. 5 and 6 show an operation of the secondary lock portion 5 occurring when the secondary latch 24 is forced to be disposed in the latching position.

As shown in FIG. 5, when the secondary latch 24 is in the latching position, the distal end portion 31*a* of the abutment portion 31 is disposed above the abutment portion 28 of the catcher 22 and is brought into abutment with the abutment portion 28 as the hood 3 is operated to be closed. As the hood 3 is operated to be closed, the secondary latch shaft 32 is lowered, whereas the distal end portion 31*a* of the abutment portion 31 which is in abutment with the abutment portion 28 is pushed upwards relatively as the secondary latch shaft 32 is lowered. This rotates the secondary latch 24 in the direction indicated by the arrow C to be disposed in the latching position, as shown in FIG. 6.

Although the hood 3 is secured to the unlatching position, the secondary latch 24 is forced to be disposed in the latching position as the hood 3 is operated to be closed. When the hood 3 is opened from the fully closed state, the catcher 22 is locked by the secondary latch 24 in an ensured fashion, this enhancing the reliability of the hood lock apparatus.

In the operation of the secondary lock portion 5 described heretofore, the secondary latch 24 is rotated about the secondary latch shaft 32 extending in the longitudinal direction of the vehicle body 2, and the hook portion 29, the operating portion 30 and the abutment portion 31 which move as the secondary latch 24 rotates move mainly in the widthwise direction and an up-and-down direction or vertical direction of the vehicle body 2. Thus, a space which is necessary in the longitudinal direction of the vehicle body 2 as the secondary latch 24 rotates is reduced. This enables the secondary lock portion 5 to be disposed close to the front end portion of the hood 3 at the front side of the vehicle body 2.

In a case where the secondary lock portion 5 can be disposed close to the front end portion of the hood 3 at the front side of the vehicle body 2, a length of the operating portion 30 of the secondary latch 24, which is extended to the front end portion of the hood 3, can be shortened. According thereto, it can reduce the rigidity of the operating portion 30, which may constitutes a resistance against a deformation of the hood 3 occurring when the vehicle is involved in a frontal collision, without sacrificing the operability of the operating portion 30, thereby enhancing the impact absorbing capability (the safety performance) of the hood 3.

Further, in a case where the secondary lock portion 5 can be disposed close to the front end portion of the hood 3, the secondary lock portion 5 can be disposed aligned with the primary lock portion 4 in the longitudinal direction of the vehicle body 2 while being disposed in a position lying further forwards toward the front side of the vehicle body 2 than the primary lock portion 4. This enables the primary lock portion 4 and the secondary lock portion 5 to be disposed substantially at the center in the widthwise direction of the vehicle body 2, whereby the hood 3 can be held safely whether the hood 3 is in the fully closed state or the half open state.

It is preferable that a rust preventive surface treatment is applied to the secondary latch 24 and the secondary base 23 (including the secondary latch shaft 32) that supports the secondary latch 24 so as to prevent the generation of rust and/or blisters which causes the secondary latch 24 to be secured to the unlatching position. A zinc plating treatment and a chromate treatment to a plated surface are widely used as a rust preventive surface treatment for steel of which the secondary base 23 and the secondary latch 24 are made. However, in this illustrative embodiment, it is preferable to use a zinc phosphate treatment in place of the chromate treatment. The secondary base 23 and the secondary latch 24 are painted in a dark color such as black from the viewpoint of reducing the visibility thereof through a front grille, for example, and a cationic electro-deposit painting is used as a painting method for painting the secondary base 23 and the secondary latch 24. A zinc phosphate coating is superior in adhesion to a cationic electro-deposited coating to a chromate coating.

Then, a primer coat and a paint coat are applied sequentially to base materials of steel which make up the secondary base 23 and the secondary latch 24 in that order. The primer coat includes a plated coat of zinc or zinc alloy and a zinc phosphate coat which is formed on a surface layer of the plated coat to thereby enhance the anti-corrosive property of the secondary base 23 and the secondary latch 24 and the adhesion strength of the paint coat, whereby the generation of rust and/or blisters on the secondary base 23 and the secondary latch 24 can be suppressed further.

Incidentally, as to the primary base 11, the primary latch 12 and the locking plate 13 of the primary lock portion 4, a primer coat and a paint coat are applied sequentially to base materials of steel which make up those constituent elements of the primary lock portion 4 in that order. The primer coat may include a plated coat of zinc or zinc alloy and a zinc phosphate coat which is formed on a surface layer of the plated coat to thereby enhance the anti-corrosive property of the primary base 11, the primary latch 12 and the locking plate 13 and the adhesion strength of the paint coat, whereby the generation of rust and/or blisters on the primary base 11, the primary latch 12 and the locking plate 13 can be suppressed.

What is claimed is:

1. A hood lock apparatus for use with a vehicle that includes a hood and a vehicle body, the hood configured to be opened and dosed on the vehicle body, the hood lock apparatus comprising:

a primary lock portion configured to hold the hood in a fully dosed state by locking the hood to the vehicle body in the fully dosed state; and a secondary lock portion configured to hold the hood in a half open state by locking the hood to the vehicle body in the half open state, wherein, in the half open state, the hood is partially opened, the secondary lock portion comprising:

a catcher configured to attach to the vehicle body;

a base configured to attach to the hood; and a latch supported on the base and configured to rotate between a latching position and an unlatching position, the latch being rotatable about a shaft that is configured to extend in a longitudinal direction of the vehicle body as a rotational center, wherein the latch comprises:

a hook portion configured to lock the catcher when the hood is opened to the half open state with the latch being at the latching position such that the hood is locked to the vehicle body in the half open state;

an operating portion configured to operate the latch to rotate toward the unlatching position; and an abutment portion configured to be brought into abutment with the catcher when the hood is dosed from the half open state to the fully dosed state with the latch being at the unlatching position, and wherein the latch is rotated to the latching position by the abutment of the abutment portion with the catcher; and wherein the hook portion includes an arc-shaped cut-out portion, and the base includes a stopper configured to be accommodated in the cut-out portion, where the stopper is brought ino abutment with one end of the cut-out portion in the latching position, and the stopper is brought into abutment with another end of the cut-out portion in the unlatching position.

2. The hood lock apparatus according to claim 1, wherein the primary lock portion and the secondary lock portion are configured to be aligned with each other in the longitudinal direction of the vehicle body, and wherein the secondary lock portion is configured to be disposed further forwards toward a front side of the vehicle body than the primary lock portion.

3. The hood lock apparatus according to claim 1, wherein the hook portion comprises:

a locking portion configured to be brought into engagement with the catcher; and a synthetic resin cover configured to cover the hook portion, except for the locking portion.

4. The hood lock apparatus according to claim 1, wherein the latch further comprises:

an elastic member provided around the shaft and configured to bias the latch in a direction toward the latching position.

5. The hood lock apparatus according to claim 1, wherein the base and the latch are formed by applying a primer coat and a paint coat sequentially to a base material of steel in that order, and wherein the primer coat includes:

a plated coat of zinc or zinc alloy; and a zinc phosphate coat that is formed on a surface layer of the plated coat.

6. The hood lock apparatus according to claim 1, wherein the latch is rotated to the latching position by the abutment portion, which is in abutment with the catcher, being pushed upwards relatively as the shaft is lowered in response to the hood being closed.

* * * * *